US007841285B2

(12) United States Patent
Howes et al.

(10) Patent No.: US 7,841,285 B2
(45) Date of Patent: Nov. 30, 2010

(54) WATERBORNE VESSEL WITH LOOP KEEL

(76) Inventors: Jonathan Sebastian Howes, 3 Chapel Cottages, Cowfold Road, Bolney, West Sussex RH17 5QU (GB); James Donnelly Macnaghten, Fernleigh Cottage, 3 Hills Avenue, Cambridge CB1 7UY (GB)

( * ) Notice: Subject to any disclaimer, the term of this patent is extended or adjusted under 35 U.S.C. 154(b) by 308 days.

(21) Appl. No.: 10/584,386

(22) PCT Filed: Dec. 20, 2004

(86) PCT No.: PCT/GB2004/005432

§ 371 (c)(1),
(2), (4) Date: Apr. 19, 2007

(87) PCT Pub. No.: WO2005/061319

PCT Pub. Date: Jul. 7, 2005

(65) Prior Publication Data

US 2008/0105187 A1 May 8, 2008

(30) Foreign Application Priority Data

Dec. 23, 2003 (GB) ..... 0329802.3
Jan. 19, 2004 (GB) ..... 0401082.3

(51) Int. Cl.
*B63B 41/00* (2006.01)
*B63B 3/38* (2006.01)
*B63B 39/06* (2006.01)

(52) U.S. Cl. ..... 114/140; 114/142; 114/274

(58) Field of Classification Search ..... 114/39.13, 114/39.15, 39.24, 126–143, 149, 152, 274–282
See application file for complete search history.

(56) References Cited

U.S. PATENT DOCUMENTS 1,549,564 A * 8/1925 Slocum ..... 440/66
2,767,678 A * 10/1956 Vertens ..... 114/274
2,917,016 A * 12/1959 Schertel ..... 114/274
2,984,197 A * 5/1961 Bader ..... 114/282
3,373,710 A * 3/1968 Steinberg ..... 114/39.24
4,058,076 A * 11/1977 Danahy ..... 114/281
4,508,046 A * 4/1985 Coulter et al. ..... 114/39.15
4,582,011 A * 4/1986 Logan ..... 114/39.24
4,628,853 A * 12/1986 Hoyt ..... 114/274

(Continued)

FOREIGN PATENT DOCUMENTS

CH 638148 A5 * 9/1983

(Continued)

*Primary Examiner*—Ajay Vasudeva
(74) *Attorney, Agent, or Firm*—Lempia Braidwood LLC

(57) ABSTRACT

A vessel (10) for traveling on water comprises a hull (20) and a keel (30) comprising a member (34) depending from the hull, the member (34) comprising two limbs (44) each depending from a respective lateral side of the hull (20), the two limbs (44) defining at least in part an enclosed flow path extending in a bow to stern direction, the enclosed flow path being configured to allow water incident on the vessel to flow over inner and outer surfaces of the limbs (44*a*, 44*b*). The limbs (44) each have a zero-lift surface which is angled to generate in use a component of hydrodynamic force directed away from the enclosed flow path when there is a net flow of water along the enclosed flow path.

24 Claims, 7 Drawing Sheets

U.S. PATENT DOCUMENTS

| | | | | |
|---|---|---|---|---|
| 4,899,679 | A * | 2/1990 | Immonen | 114/61.32 |
| 4,981,099 | A * | 1/1991 | Holder | 114/274 |
| 6,467,422 | B1 | 10/2002 | Elms | |
| 6,499,419 | B1 * | 12/2002 | Bussard | 114/274 |
| 6,739,925 | B2 * | 5/2004 | Burns et al. | 441/79 |
| 2003/0040236 | A1 | 2/2003 | Burns et al. | |

FOREIGN PATENT DOCUMENTS

| | | | |
|---|---|---|---|
| CH | 693206 | A5 * | 4/2003 |
| DE | 4344740 | A1 | 12/1993 |
| DE | 19522035 | A1 * | 12/1996 |
| GB | 2177353 | A | 1/1987 |
| JP | 59202990 | A * | 11/1984 |
| JP | 61200080 | A * | 9/1986 |
| JP | 05050979 | A * | 3/1993 |
| JP | 07156870 | A * | 6/1995 |
| WO | WO 95/18036 | | 7/1995 |
| WO | WO 99/22986 | | 5/1999 |
| WO | WO 01/60690 | | 8/2001 |

* cited by examiner

WATERBORNE VESSEL WITH LOOP KEEL

The present invention relates generally to a waterborne vessel having an improved keel, and particularly, but not exclusively, to a sailing vessel having an improved keel.

Fin keels (e.g. comprising a single fin supporting a ballast bulb) are well known in the art as a means of providing lateral stability to conventional sailing vessels. However, there are a number of problems associated with fin keels. For example, fin keels are structurally vulnerable to impacts and dynamic loads, with flexure of a fin keel having the potential to cause substantial damage thereto, particularly if cyclically applied loads (e.g. due to waves) are close to the natural frequency of the keel. Furthermore, efficient fin keels require a deep draught to ensure an adequate lifting efficiency. High aspect ratio fins suffer from a low stalling angle which can lead to control problems in rough conditions, and in the worst cases can lead to regular loss of control of a vessel. In contrast, shorter (i.e. shallow draught) keels may be strong, but deliver poor upwind performance due to increased vortex drag.

A common solution to the problems relating to fin keels is to use a twin keel arrangement in which two shallow-draught fin keels are used instead one deep draft keel. Generally, the two keels are splayed outwards and provided with a small amount of "toe in" such that when a vessel is heeled, the leeward keel becomes more upright and is angled to best resist leeway. However, once in this orientation, the weather keel acts to increase heel, and both keels will produce substantial vortex drag. Although it is possible to design a hull for a twin keel arrangement such that the weather keel generates reduced force with increased heel, this is generally at the cost of hull performance. Furthermore, when sailing upright (e.g. downwind), both keels produce a counter-rotating vortex pair which also carries a significant drag penalty.

Another attempt at addressing some of the problems relating to fin keels is disclosed in GB 2177353 (Rennie), in which a keel is shown which comprises a pair of streamlined side foils depending (e.g. extending) symmetrically from lateral sides of a hull, the side foils converging to a junction below a centre-line of the hull to form an enclosed flow path for allowing water to pass through the keel. The purpose of this arrangement is primarily concerned with the provision of a keel which is efficient in operation, namely by seeking to reduce induced drag experienced by the keel.

The present applicants have identified the need for a sailing vessel having an improved keel which overcomes, or at least alleviates, some of the problems associated with conventional keel arrangements.

In accordance with a first aspect of the present invention there is provided a vessel for travelling on water, comprising a hull means and a keel comprising a member depending from the hull means, the member comprising two limbs each depending from a respective lateral side of the hull means, the two limbs defining at least in part an enclosed flow path extending in a bow to stern direction, the enclosed flow path being configured to allow water incident on the vessel to flow over inner and outer surfaces of the limbs, characterised in that the limbs each have a zero-lift surface which is angled to generate in use a component of hydrodynamic force directed away from the enclosed flow path when there is a net flow of water along the enclosed flow path (i.e. a flow incident in the bow to stern direction).

In this way, a keel with an enclosed flow path (or "loop keel" defining a "loop") is provided which, when submerged in water in use, may result in a closed loop of hydrodynamic force, all directed away from (the centre of) the enclosed closed flow path. This situation is equivalent to a vortex ring in a continuous flow and, unless an overall lateral force is being generated on the loop keel, should not result in substantial vorticity being shed by the loop keel.

In use, the angling of the zero-lift surface to generate an outward force may vary the degree by which the flow within the equivalent vortex ring is accelerated; this may manifest itself as an increase in the apparent inertia of the vessel (known in aerodynamics as the "added mass effect"). This inertia travels with the vortex ring and is experienced by the vessel as a significant increase in longitudinal and roll inertia, a small increase in yaw and pitch inertia, and some increase in heave and lateral inertia. This may have the effect of reducing the violence of the vessel's response to waves and other upsets.

In use, if the vessel should experience a significant heel angle such that part of one limb is partially clear of, and above the water surface, the other, lowest limb, by virtue of the angling of the zero-lift surface, generates a righting moment (assuming forward motion of the vessel is present). At lower angles of heel, the forces on the limbs of the loop will tend to force water to fill or partially fill the loop even when the loop is partially above the water surface. This manifestation of the added mass effect also now forms an additional dynamic ballast element in that the water within the loop that has been raised above the static waterline is now providing a weight-derived righting moment acting directly on the keel members. Any roll disturbance of the keel under forward motion may therefore generate a substantial righting moment.

At least one limb of the loop keel member may comprise a portion having a symmetrical aerofoil cross-section (for example, at least one limb may comprise a cross-section similar to a conventional fin keel), in which case, the portion will be aligned so that water will be incident on the inner surface of the limb so as to generate force away from the loop. In another form, at least one limb of the loop keel member may be cambered (for example, at least one limb may comprise an asymmetric foil section) to provide force generation away from the centre of the loop. In yet another form, the angle of the zero-lift surface of at least one limb may be variable. For example, at least one limb may be of variable camber (e.g. at least one limb may comprise a moveable flap) or a portion of at least one limb may be moveable (e.g. rotatable). For example, the loop keel may comprise a trailing- or leading-edge flap or both, or the loop keel may comprise one or more moveable limbs. In this way, the limbs may be angled so as to generate a continuous outward force all around the loop.

If the limbs of the keel are provided with a means to vary the angle of the zero-lift surface, e.g. by means of flaps or rotation of key parts of the limbs about their longitudinal axes, the apparent inertia of the entire vessel may be varied at will. This effect may be used to trade longitudinal momentum between the vessel and surrounding water with only minimal losses. This would allow a vessel so equipped to transiently slow down and speed up without any significant variation in power input. One possible use may be for collision avoidance in racing situations where this could be used as a lossless brake. Furthermore, this effect may be of considerable use in the field of racing since, if a boat arrived at a start line for a race a couple of seconds early, some of the kinetic energy of the boat could be temporarily transferred to the water and then recovered after the starting gun had fired.

The two limbs may each comprise a substantially straight portion. For example, the member may comprise a pair of substantially straight limbs connected together to form a V-shape (when viewed from the bow or stern of the sailing vessel) with a portion of the hull means completing the loop to form the enclosed flow path. In another form, the two limbs may be substantially curved.

The two limbs may be symmetrically disposed on either side of a central, longitudinal axis of the hull means. The loop keel may be similarly symmetrical. The two limbs of the loop keel may be connected together direct or, for example, via a ballast bulb.

For improved hydrodynamic performance, the two limbs may be directed (e.g. curved) inwards toward the hull means where they depend from the hull means. For example, the two limbs may be substantially perpendicular to the hull means at the point where they meet the hull means, with the objective of minimising interference drag between the loop keel and the hull means, and to encourage the loop to break the water surface during significant heeling. Chord and camber parameters of each limb may be locally increased and reduced respectively where the limbs meet the hull means to reduce the curvature experienced by the longitudinal flow at the waterline. In this way, wave drag may be reduced when the vessel is more or less upright.

At least one limb of the loop keel member may have a part having a sharp or small radius leading-edge (i.e. an edge facing the bow direction). For example, the part may have a leading-edge radius of 1.0 mm or less. In another form, the part may have a leading-edge radius of 0.5 mm or less. The part may be located where the limb meets the hull means. In this way, spray drag in the region where the keel intersects with the hull may be reduced. The part may extend along a substantial length of the at least one limb. For example, a sharp or small radius leading-edge may be provided around the whole loop. At least one limb may have a part having a leading edge which is locally swept relative to the central, longitudinal axis of the hull means. For example, the longitudinal distance between the leading edge of the part and a rearmost part (i.e. stern) of the hull means may decrease (i.e. be swept aftward) with increasing distance from the hull means. In this way, local stall resistance of the part may be increased. In the case of a limb having a part with a sharp or small radius leading-edge, this increase in local stall resistance may be used to counter the inherent lower stall resistance of the sharp or small radius leading-edge section. The resulting swept leading edge will in use induce a localised vorticity that reduces the severity of pressure gradients around the leading edge.

Each limb of the loop keel member may have a lower part (i.e. further away from where the limb meets the hull means) which is longitudinally offset (e.g. forward or aftward) relative to an upper part thereof. The lower portion of each limb may be offset relative to the upper part, either towards the bow of the hull means (swept forward) or towards the stern of the hull means (swept aftward). When part of the loop keel member is exposed above water (e.g. during heeling), such swept configurations cause the longitudinal centre of effort (e.g. longitudinal location of the centre of lateral resistance) of submerged parts of the keel to move forward or aftward respectively relative to its original upright location when the vessel is upright or no heeling. This may be of great benefit for a sailing vessel as a significant effect of heel is to move the centre of effort of the rig to leeward of the hull, thereby causing a turning moment to windward to be generated (weather helm). If partnered with an appropriately swept loop keel, this turning moment may be partially or even wholly negated by a corresponding aftward shift of the keel centre of effort. With certain forms of hull means, a forward shift of the centre of effect with increasing heel angle is desirable in which case a forward sweep would be appropriate.

The vessel may be a sailing vessel (i.e. intended to be propelled using at least one sail). However, the present invention is also applicable to non-sailing vessels (i.e. vessels not employing a sail, e.g. fishing vessels, survey craft or ferries); the inertia effects the vortex ring and dynamic righting moment that is generated by the loop keel may be of great use in such vessels. The righting moment generated by the loop keel will tend to maintain the hull in a substantially upright position in the water (e.g. force the vertical axis of the hull to remain substantially normal to the water surface) as long as the vessel is in forward motion, and has clear benefits in terms of ride comfort and seaworthiness for any vessel.

The hull means may be a monohull or, alternatively, the hull means may comprise a multi-hull arrangement, provided that there is a hydrodynamic surface to form the loop.

The keel may further comprise a ballast portion. For example, the loop keel may comprise a ballast bulb disposed at a lowest part of the keel (e.g. at the apex of a V-shaped loop keel). Alternatively, or in addition, the loop keel may further comprise a substantially planar, horizontal element disposed at a lowest part of the loop keel member, and containing ballast. The substantially planar surface may be configured to support the sailing vessel when grounded, e.g. between tides. At the base of the loop keel, the two limbs may be angled (e.g. curved) to smoothly meet the ballast bulb. However, many of the advantages of the present invention are also applicable for an unballasted keel.

In accordance with a second embodiment of the present invention, there is provided a vessel for travelling on water, comprising a hull means and a keel comprising a member depending from the hull means, the member comprising two limbs each depending from a respective lateral side of the hull means, the two limbs defining at least in part an enclosed flow path extending in a bow to stern direction, the enclosed flow path being configured to allow water incident on the vessel to flow over inner and outer surfaces of the limbs, characterised in that at least one limbs has a part having a sharp or small radius leading-edge (i.e. an edge facing the bow direction).

The part may have a leading-edge radius of 1.0 mm or less. In another form, the part may have a leading-edge radius of 0.5 mm or less. The part may be located where the at least one limb meets the hull means. In this way, spray drag in the region where the keel intersects with the hull may be reduced. The part may extend along a substantial length of the at least one limb. For example, a sharp or small radius leading-edge may be provided around the whole loop.

Additional embodiments of this aspect of the invention may additionally include any of the features described above with reference to the first aspect of the present invention.

In accordance with a third aspect of the present invention, there is provided a vessel for travelling on water, comprising a hull means and a keel comprising a member depending from the hull means, the member comprising two limbs each depending from a respective lateral side of the hull means, the two limbs defining at least in part an enclosed flow path extending in a bow to stern direction, the enclosed flow path being configured to allow water incident on the vessel to flow over inner and outer surfaces of the limbs, characterised in that at least one limb has a part having a leading edge which is locally swept relative to a central, longitudinal axis of the hull means. For example, the longitudinal distance between the leading edge of the part and a rearmost part (i.e. stern) of the hull means may decrease (i.e. be swept aftward) with increasing distance from the hull means. In this way, local stall resistance of the part may be increased.

In the case of a limb having a part with a sharp or small radius leading-edge, this increase in local stall resistance may be used to counter the inherent lower stall resistance of the sharp or small radius leading-edge section. The resulting swept leading edge will in use induce a localised vorticity that reduces the severity of pressure gradients around the leading edge.

Additional embodiments of this aspect of the invention may additionally include any of the features described above with reference to the first aspect of the present invention.

In accordance with a fourth aspect of the present invention, there is provided a vessel for travelling on water, comprising a hull means and a keel comprising a member depending from the hull means, the member comprising two limbs each depending from a respective lateral side of the hull means, the two limbs defining at least in part an enclosed flow path extending in a bow to stern direction, the enclosed flow path being configured to allow water incident on the vessel to flow over inner and outer surfaces of the limbs, characterised in that the each limb of the loop keel member has a lower part (i.e. further away from where the limb meets the hull means) which is longitudinally offset (e.g. forward or aftward) relative to an upper part thereof.

The lower portion of each limb may be offset relative to the upper part, either towards the bow of the hull means (swept forward) or towards the stern of the hull means (swept aftward). When part of the loop heel member is exposed above water (e.g. during heeling) such swept configurations cause the longitudinal centre of effort (e.g. longitudinal location of the centre of lateral resistance) of submerged parts of the keel to move forward or aftward respectively relative to its original location when the vessel is upright or not heeling. This may be of great benefit for a sailing vessel as a significant effect of heel is to move the centre of effort of the rig to leeward of the hull, thereby causing a turning moment to windward to be generated (weather helm). If partnered with an appropriately swept loop keel, this turning moment may be partially or even wholly negated by a corresponding aftward shift of the keel centre of effort. With certain forms of hull means, a forward shift of the centre of effect with increasing heel angle is desirable in which case a forward sweep would be appropriate.

Additional embodiments of this aspect of the invention may additionally include any of the features described above with reference to the first aspect of the present invention.

Embodiments of the present invention will now be described by way of example with reference to the accompanying drawings in which.

Figure 1:
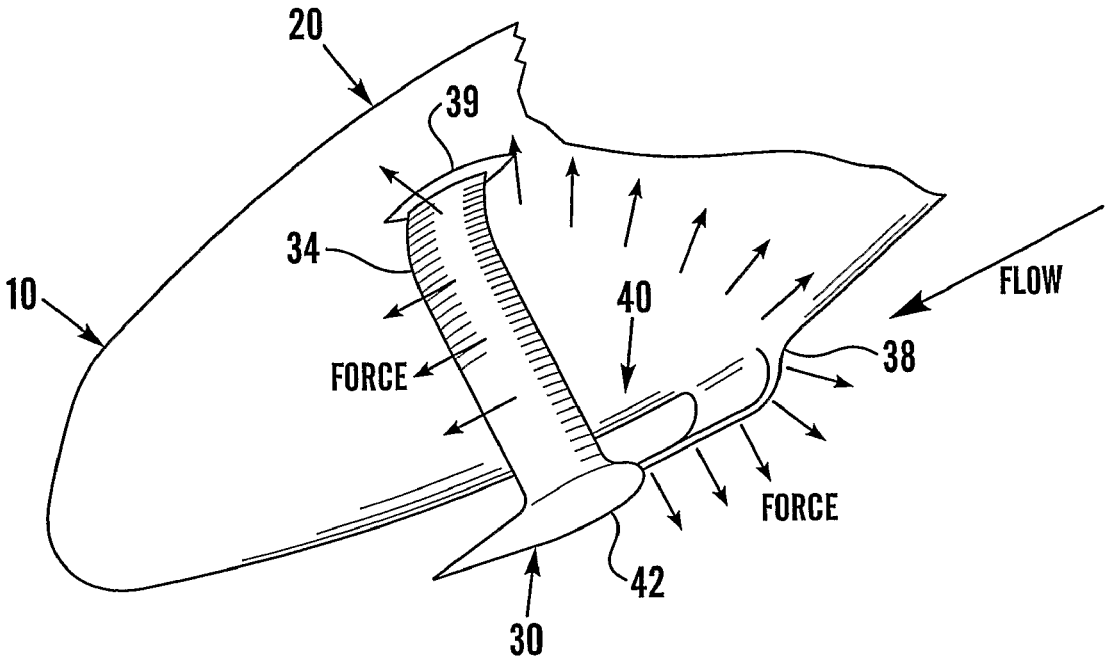
FIG. 1 shows a schematic perspective view of an underside of a sailing vessel according to a first embodiment of the present invention.

FIGS. 1, 3, 4A and 4B show a sailing vessel 10 comprising a hull 20 and a loop keel 30, the loop keel 30 comprising a substantially V-shaped looped keel member 34 attached to the hull 20 at two laterally spaced locations 38,39. The looped keel member 34 comprises a pair of limbs 44, each having substantially straight fin-like portions 45 which are attached at one end to a central ballast bulb 42, and curved, upper portions 46 which attach the loop keel to the hull 20 at the two laterally spaced locations 38,39. The pair of limbs 44 in combination with the hull 20, form an enclosed flow path (a "loop" or aperture) 40 through which water may pass.

Figure 2:
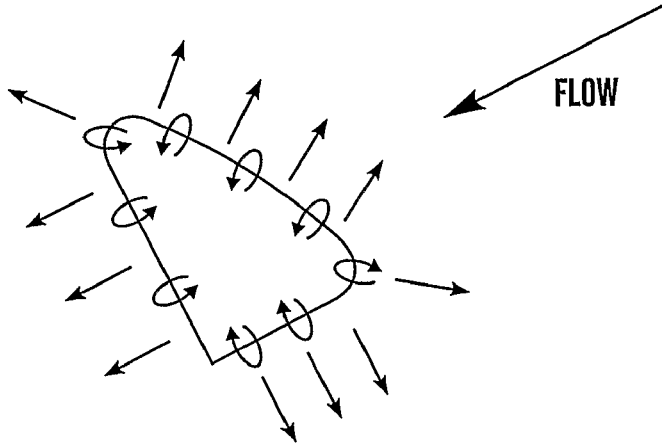
FIG. 2 shows a force diagram representing the vortex ring produced by the loop keel of the sailing vessel shown in FIG. 1.
Figure 3:
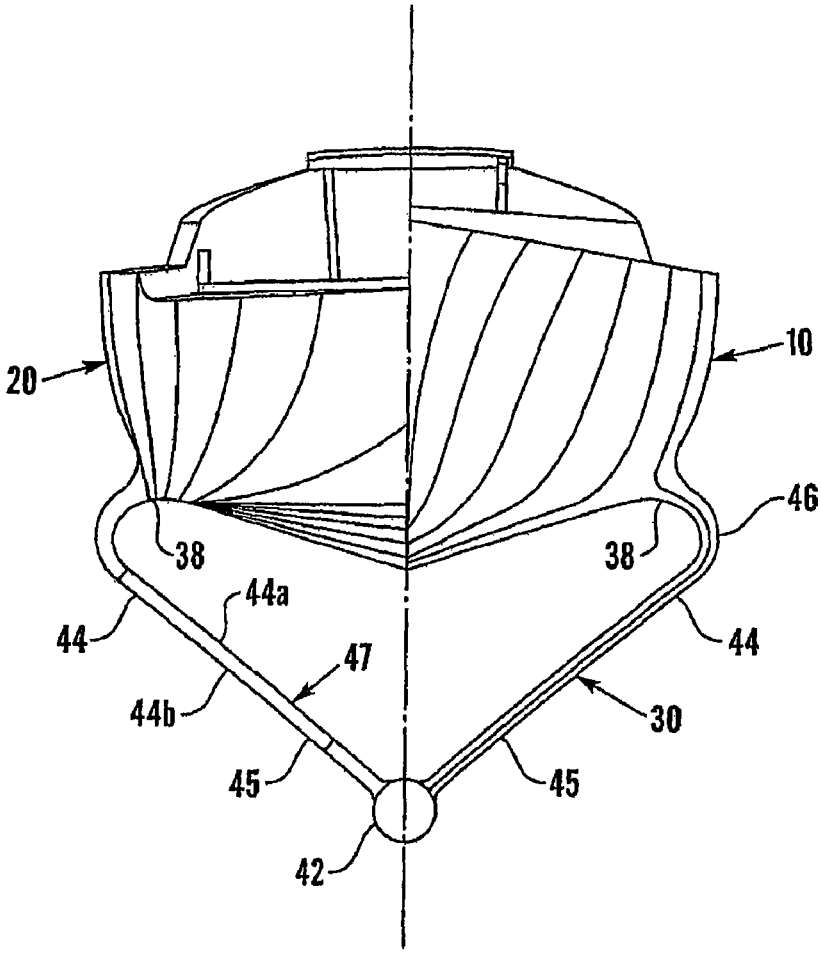
FIG. 3 shows a split schematic front/rear view of the sailing vessel of FIG. 1.

The limbs 44 comprise inner and outer surfaces (44*a*,44*b*) which are configured so as to generate a continuous outwards force all around the loop (this is directly equivalent to a vortex ring in a continuous flow). For example, fin-like portions 45 may have a cambered or uncambered foil profile having a zero lift surface which is angled to generate a component of hydrodynamic force directed away from the enclosed flow path 40 when the loop keel 30 passes through incident water. As shown in FIG. 1, the inner and outer surfaces 44*a*, 44*b* may extend between forward and rearward edges of each limb 44, with each of the inner and outer surfaces 44*a*, 44*b* being continuous over its entire length between the forward and rearward edges. Additionally, the pair of limbs 44 may include one or more moveable flaps 47 to vary the angle of the zero-lift surface and thereby control apparent inertia of the sailing vessel 10. FIG. 2 shows schematically the equivalent vortex ring produced by the loop keel 30 when zero overall lateral force is applied thereto.

Figure 5:
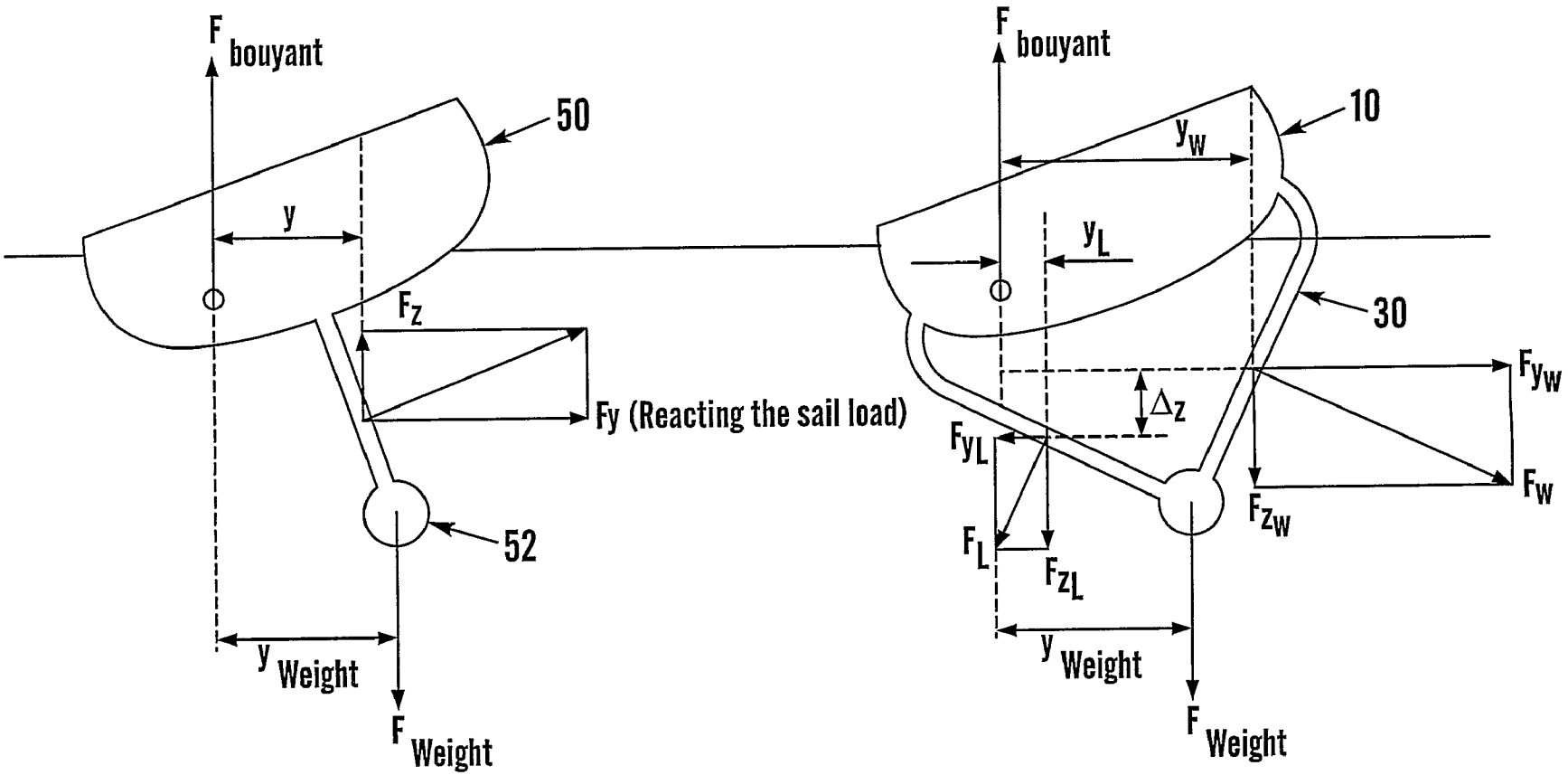
FIG. 5 shows the sailing vessel of FIG. 1 compared with a conventional fin keel sailing vessel in a heeling position.

FIG. 5 shows various forces acting on the sailing vessel 10 in a heeled position as compared with the forces acting on a conventional sailing vessel 50 comprising a fin keel 52. Whereas all the dynamic forces shown acting on the fin keel 52 act to increase the heeling moment, all of the dynamic forces shown acting on the loop keel 30 act to reduce the heeling moment. The ballast effect for both keels is similar.

Figure 6:
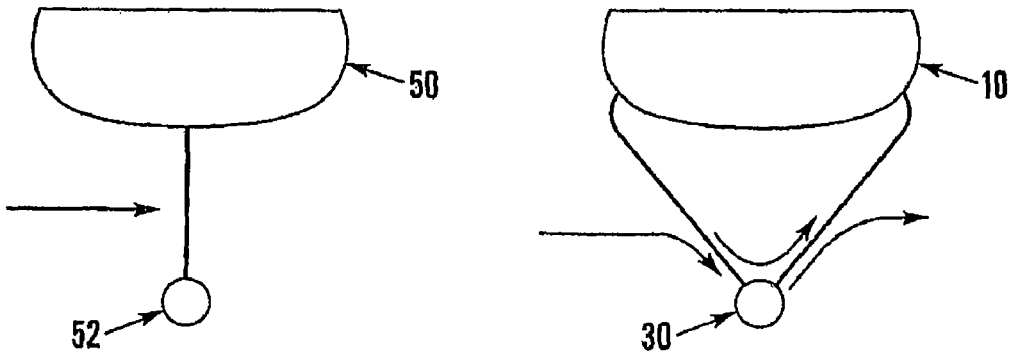
FIG. 6 shows a schematic representation of the sailing vessel of FIG. 1 and the convention single heel sailing vessel of FIG. 5 in a cross-flow.
Figure 4A:
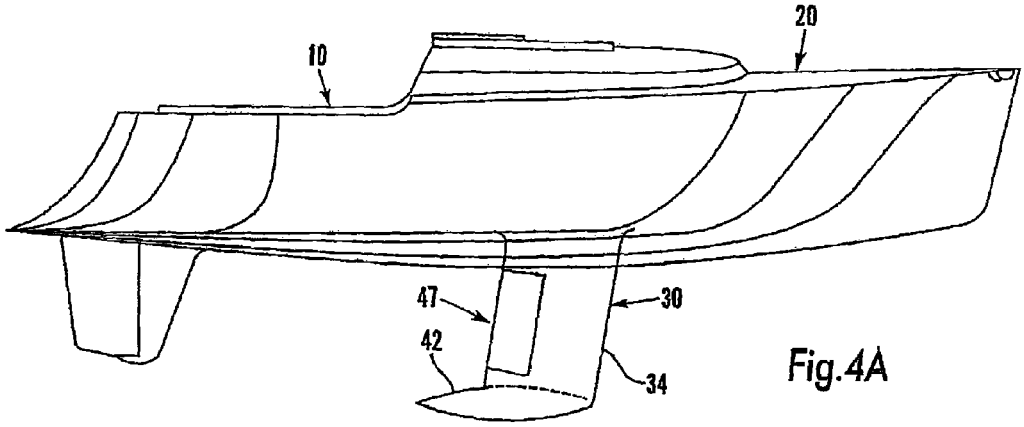
FIG. 4A shows a schematic side view of the sailing vessel of FIG. 1.
Figure 4B:
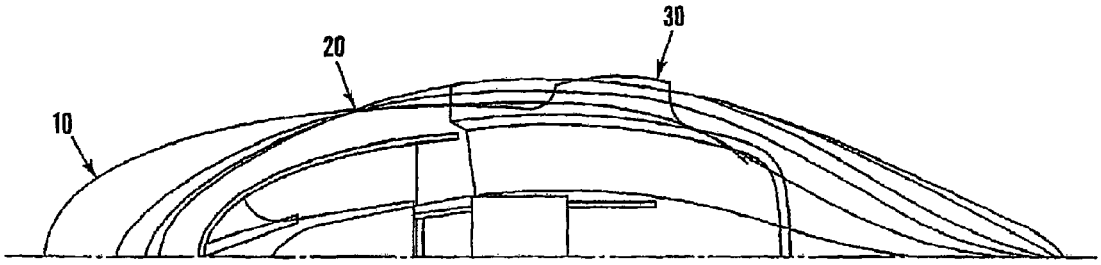
FIG. 4B shows a schematic plan view of one half of the sailing vessel of FIG. 1.

FIG. 6 shows the conventional fin keel 52 and the loop keel 30 in a cross flow. With a conventional fin keel, any cross-flow results in a sudden increase in incidence. In contrast, cross-flow results in a component of flow along the limbs 44. When coupled with fore and aft flow, this acts to reduce the local incidence change, and thereby provides improved stall resistance. The advantages of the present invention may be explained as follows. When the rig of the sailing vessel is loaded, the effect is to both load the loop keel laterally to resist the rig load and to generate a heeling moment to leeward. The effect of this on the loop keel is to cause the weather limb of the loop keel to become more upright and also, depending on the particular design, to break the water surface and thus disturb the equivalent vortex ring of the unloaded keel. As this limb is angled to generate force away from the centre of the loop, it is ideally placed to generate an efficient leeway resisting force, this force is also generated without requiring the hull to crab as with a conventional fixed fin and this can be used to reduce the heeled hull drag. It also has a further advantage over a fin keel in this condition, since the other limb of the keel (the leeward limb) still provides surface continuity and acts in the same manner as an aircraft winglet increasing the effective aspect ratio of the keel and thus reducing the vortex drag. The leeward limb generates a force both downward and to a lesser degree to leeward. The hull, due to the heeling angle, also moves the centre of buoyancy to leeward (form stability) and the force from the leeward keel limb is offset from the centre of buoyancy to weather, this results in a dynamic righting moment. The overall result is that a loop keel equipped yacht should sail to windward with less drag and less heel than a similar yacht equipped with a fin keel.

Yet a further advantage of the loop keel is that the limbs of the keel will always offer some element of the working keel surface to the water flow at a lateral angle, which will tend to cause a degree of cross flow which has the effect of increasing resistance to stalling. The keel will thus generate lift to high angles of attack and be highly resistant to stall in rough conditions. The loop keel is also of a naturally sturdy and stiff structural form and is very unlikely to suffer from elastically induced dynamic overloads.

If two otherwise similar sailing vessels are equipped with a fin keel and a competing loop keel of similar draught, the loop keeled vessel will sail downwind with a similar performance to the fin-keeled vessel. However, as soon as the course is such as to place a lateral load on the keel, the loop keeled vessel will sail faster, with less heel and thus a correspondingly more efficient rig, and will be more controllably in extreme conditions. It will also be significantly stronger. If the performance of the two vessels is matched, the loop keeled vessel will have a lower draught than the fin keeled vessel; this reduction in draught is likely to be of the order of 20% to 30%.

Figure 7A:
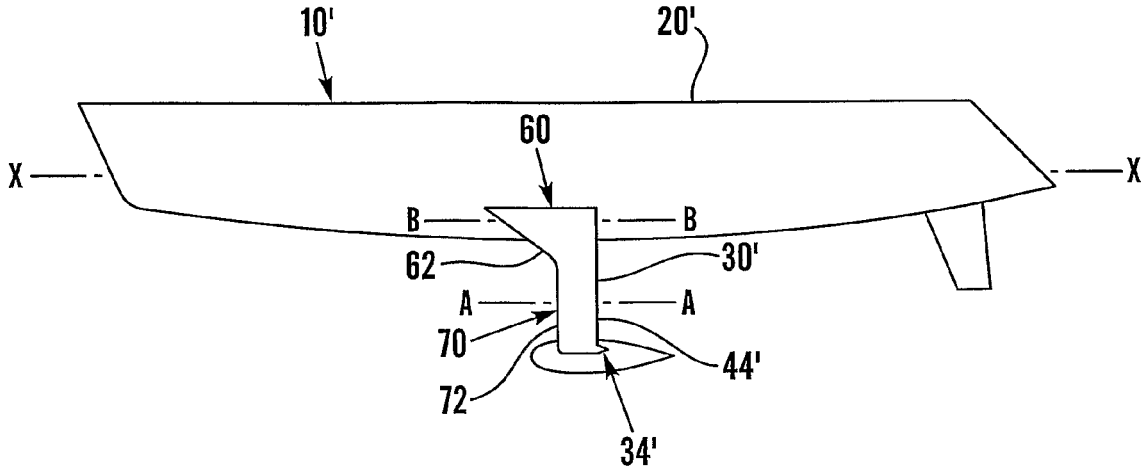
FIG. 7A shows a schematic side view of a sailing vessel according to a second embodiment of the present invention.
Figure 7B:
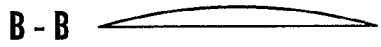
FIG. 7B shows a cross-section of an aerofoil of the sailing vessel of FIG. 7A along line B-B.
Figure 7C:
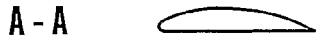
FIG. 7C shows a cross-section of the aerofoil of FIG. 7B along line A-A.

FIG. 7A shows a sailing vessel 10' comprising a hull 20' and a loop keel 30'. The loop keel 30' comprises a pair of limbs 44' forming a substantially V-shaped looped keel member 34'. Each of the limbs 44' comprises an upper section 60 meeting the hull means and a lower section 70, the upper section 60 having a sharp or small radius leading-edge 62 (e.g. with a leading-edge radius of substantially 0.5 mm) configured to reduce spray drag in the region where the keel intersects with the hull. The leading-edge 62 of the upper section 60 is inclined at an acute angle to the central, longitudinal axis "X" of the hull 20' (or, in other words, inclined at an acute angle to an axis normal to the mean flow direction of the sailing vessel 10') with the leading-edge 62 extending towards the stern of the hull (i.e. swept aftward). The lower section 70, which is contiguous with the upper section 60, has a relatively blunt leading-edge 72 which is substantially perpendicular to the central, longitudinal axis "X" of the hull 20'.

Figures 8A, 8B:
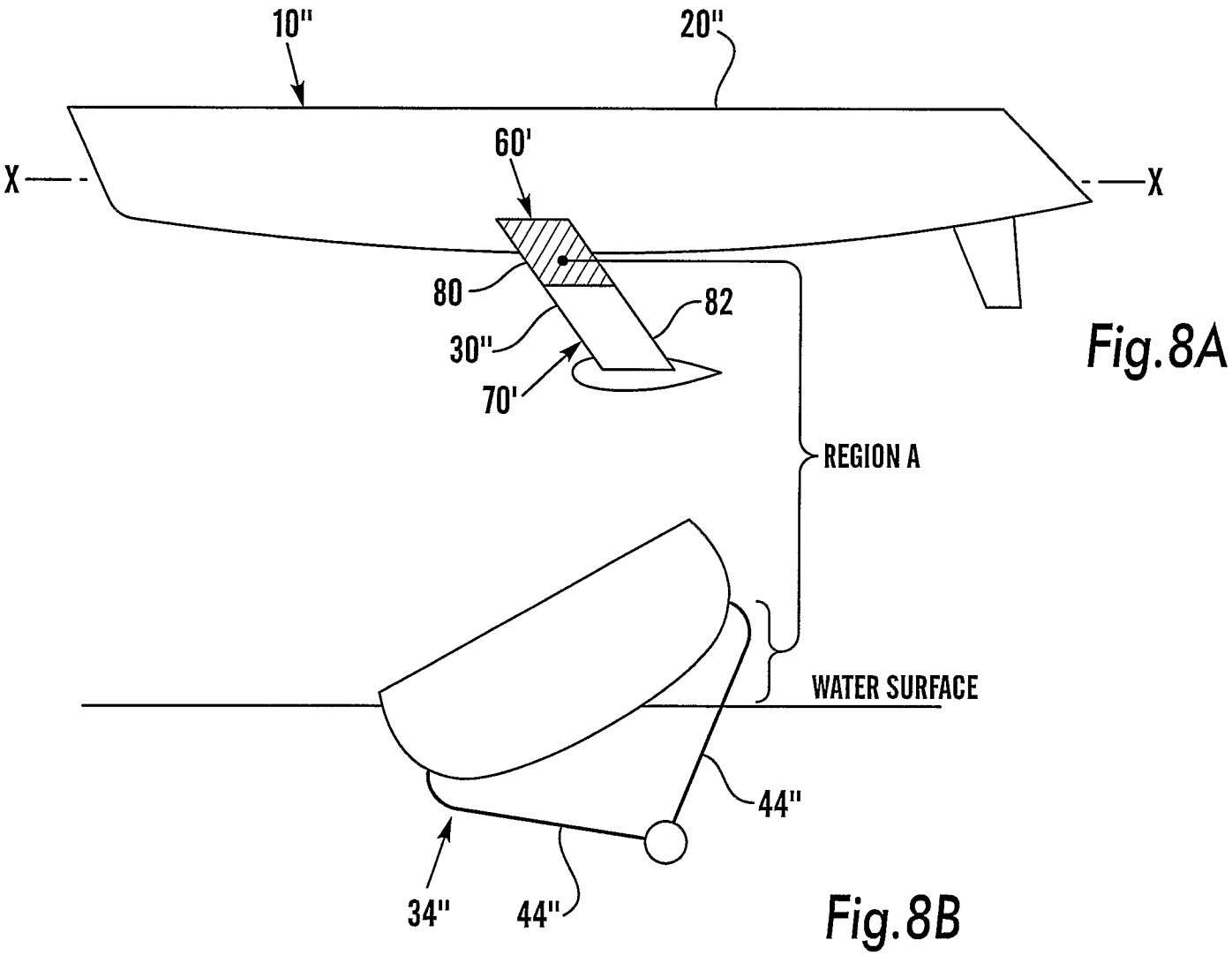
FIGS. 8A and 8B show respectively schematic side and end views of a sailing vessel according to a third embodiment of the present invention.

FIGS. 8A and 8B show a sailing vessel 10" comprising a hull 20" and a loop keel 30". The loop keel 30" comprises a pair of limbs 44" forming a substantially V-shaped keel member 34". Each of the limbs 44" comprises leading- and trailing-edge surfaces 80, 82 respectfully which are inclined at an acute angle to the central, longitudinal axis "X" of the hull 20" in an aftward direction. As shown, the leading- and trailing-edges 80, 82 are of substantially equal length and are inclined at substantially the same angle to the central, longitudinal axis "X". Thus, each limb 44" comprises an upper part 60' and a lower part 70', with the lower part 60' being longitudinally offset relative to the upper part 70' towards the stern of the hull 20". In use, as the weather limb leaves the water with increasing heel angel, a portion of upper part 60' of the weather limb is raised above the waterline (labelled Region A). This portion of part 60' will no longer be generating hydrodynamic force (i.e. is taken out of effective use by this mechanism) and represents a subtraction of effective surface ahead of the mean lateral centre of area of the keel. As a consequence, the longitudinal centre of effort of the parts of the loop keel 30" remaining below the waterline (including lower part 70') will move aftward relative to the original upright location (i.e. the effective centre of lateral resistance of the surface remaining below the water line is aftward of the location of this centre when the vessel is upright).

ANNEX

Figure 9A:
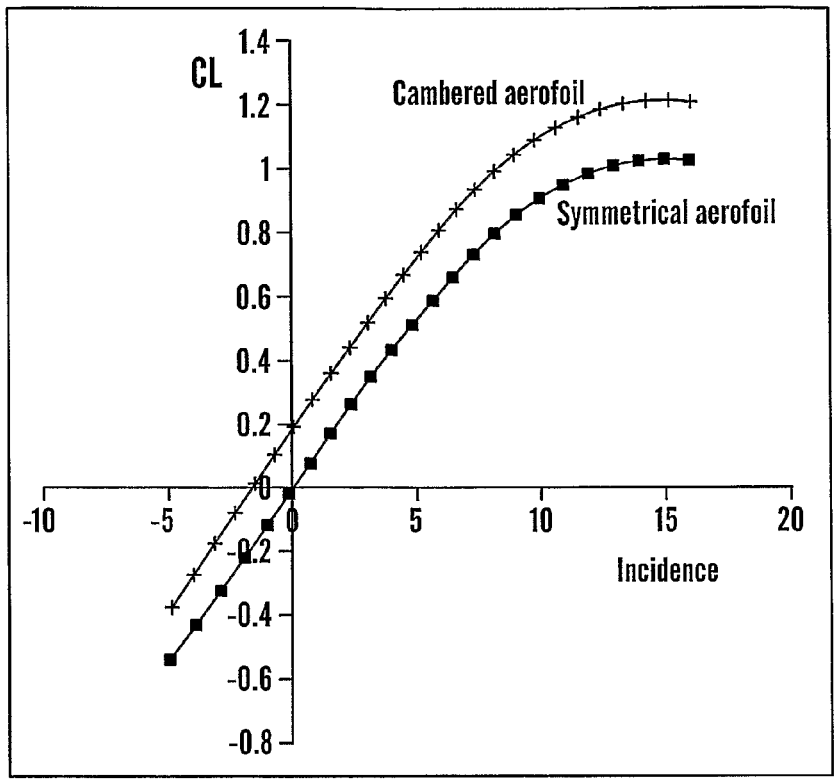
FIG. 9A shows a graph illustrating the concept of the zero lift surface.
Figure 9B:
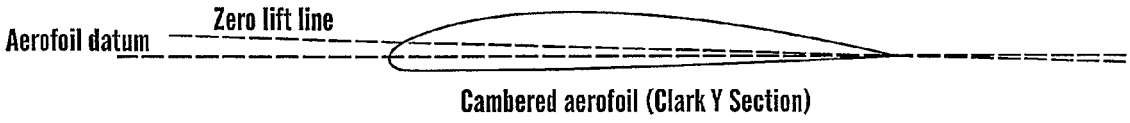
FIG. 9B shows a cross-sectional diagram of a cambered aerofoil.
Figure 9C:
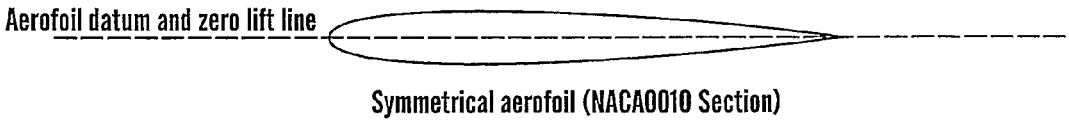
FIG. 9C shows a cross-sectional diagram of an uncambered aerofoil.

The graph of FIG. 9A illustrates the concept of the zero lift surface for a cambered (i.e. asymmetric) aerofoil and an uncambered (symmetrical) aerofoil, as illustrated in FIGS. 9B and 9C respectively. The graph shows a plot of the lift coefficient (CL) versus the incidence in degrees for both the aerofoils.

The cross-section of the cambered aerofoil has two lines superimposed on it, one of which is the geometric datum of the foil section (i.e., the line about which the aerofoil co-ordinates are defined for plotting purposes), the other of which represents the zero lift line for this aerofoil. It should be noted that the zero lift line relates to a 2 dimensional aerofoil section. When this is related to a real foil surface the zero lift lines of every local aerofoil section merge together to form the zero lift surface. This may be planar but in the case of a non-planar foil this need not be the case.

As shown, at an angle of incidence of zero degrees, the cambered aerofoil will generate positive lift. However, at an angle of approximately minus two degrees the lift generated is zero. This means that to generate zero lift the cambered aerofoil must be set at an angle to the flow of about minus two degrees and this flow datum is shown on the cross-section of the chambered aerofoil as the zero lift line.

The lift slope for the uncambered aerofoil is also shown on the graph. In contrast to the cambered aerofoil, this arrangement produces zero lift at an incidence of zero degrees. In this case, and for any symmetrical section or form including flat plates and bluff bodies, the zero lift line coincides with the axis of symmetry of the body or foil.

The lift gradient with incidence of both the symmetrical and cambered forms is similar. The corollary of this is that over the approximately linear range of foil behaviour the lift is directly proportional to the incidence of the zero lift line relative to the undisturbed fluid flow axis (i.e., the flow axis of the fluid in the absence of the foil).

The invention claimed is:

1. A vessel for traveling on water, comprising:

a hull; and a keel comprising a member depending from the hull, the member comprising two limbs each depending from a respective lateral side of the hull, the two limbs defining at least in part an enclosed flow path extending in a bow-to-stern direction, the enclosed flow path being configured to allow water incident on the vessel to flow over inner and outer surfaces of the two limbs, wherein the two limbs each have a foil surface which is angled to generate in use a component of hydrodynamic force directed outwardly from the enclosed flow path when there is a net flow of water incident in the bow-to-stern direction, each limb having a forward edge and a rearward edge, the inner and outer surfaces extending between the forward and rearward edges, wherein each of the inner and outer surfaces is continuous over its entire length between the forward and rearward edges, and wherein the keel further comprises a ballast bulb disposed at a lowest part of the keel.

2. The vessel of claim 1, wherein at least one limb of the two limbs comprises a portion having a symmetrical foil section.

3. The vessel of claim 1, wherein at least one limb of the two limbs comprises an asymmetric foil section.

4. The vessel of claim 1, wherein the angle of the foil surface of at least one limb of the two limbs is variable.

5. The vessel of claim 4, wherein at least one limb of the two limbs is of variable camber.

6. The vessel of claim 5, wherein the member comprises a flap being movably attached to one of the two limbs.

7. The vessel of claim 5, wherein a portion of at least one limb of the two limbs is moveable.

8. The vessel of claim 1, wherein the two limbs each comprise a substantially straight portion.

9. The vessel of claim 8, wherein the two limbs comprise a pair of substantially straight limbs connected together to form a V-shape as viewed in the bow-to-stern direction with a portion of the hull completing a loop to form the enclosed flow path.

10. The vessel of claim 1, wherein the two limbs are substantially curved.

11. The vessel of claim 1, wherein the two limbs are symmetrically disposed on either side of a central, longitudinal axis of the hull.

12. The vessel of claim 1, wherein the two limbs are directed inwards toward the hull where they depend from the hull.

13. The vessel of claim 12, wherein the two limbs are substantially perpendicular to the hull at the point where they meet the hull.

14. The vessel of claim 1, wherein at least one limb of the keel has a part having a sharp or small radius leading-edge.

15. The vessel of claim 1, wherein at least one limb of the two limbs has a part having a leading edge which is locally swept relative to a central, longitudinal axis of the hull.

16. The vessel of claim 15, wherein longitudinal distance between the leading edge of the part and a rearmost part of the hull decreases with increasing distance from the hull.

17. The vessel of claim 1, wherein each limb of the two limbs has a lower part which is longitudinally offset relative to an upper part thereof.

18. The vessel of claim 17, wherein the lower part of each limb of the two limbs is offset relative to the upper part towards a rear part of the hull.

19. A vessel for traveling on water, comprising:

a hull; and a keel comprising a member depending from the hull, the member comprising two limbs each depending from a respective lateral side of the hull, the two limbs defining at least in part an enclosed flow path extending in a bow-to-stern direction, the enclosed flow path being configured to allow water incident on the vessel to flow over inner and outer surfaces of the two limbs, wherein the two limbs each have a foil surface which is angled to generate in use a component of hydrodynamic force directed outwardly from the enclosed flow path when there is a net flow of water incident in the bow-to-stern direction, each limb having a forward edge and a rearward edge, the inner and outer surfaces extending between the forward and rearward edges, wherein each of the inner and outer surfaces is continuous over its entire length between the forward and rearward edges, wherein the two limbs each comprise a substantially straight portion, and wherein the two limbs comprise a pair of substantially straight limbs connected together to form a V-shape as viewed in the bow-to-stern direction with a portion of the hull completing a loop to form the enclosed flow path.

20. A vessel for traveling on water, comprising:

a hull; and a keel comprising a member depending from the hull, the member comprising two limbs each depending from a respective lateral side of the hull, the two limbs defining at least in part an enclosed flow path extending in a bow-to-stern direction, the enclosed flow path being configured to allow water incident on the vessel to flow over inner and outer surfaces of the two limbs, wherein the two limbs each have a foil surface which is angled to generate in use a component of hydrodynamic force directed outwardly from the enclosed flow path when there is a net flow of water incident in the bow-to-stern direction, each limb having a forward edge and a rearward edge, the inner and outer surfaces extending between the forward and rearward edges, wherein each of the inner and outer surfaces is continuous over its entire length between the forward and rearward edges, and wherein the two limbs are substantially curved.

21. A vessel for traveling on water, comprising:

a hull; and a keel comprising a member depending from the hull, the member comprising two limbs each depending from a respective lateral side of the hull, the two limbs defining at least in part an enclosed flow path extending in a bow-to-stern direction, the enclosed flow path being configured to allow water incident on the vessel to flow over inner and outer surfaces of the two limbs, wherein the two limbs each have a foil surface which is angled to generate in use a component of hydrodynamic force directed outwardly from the enclosed flow path when there is a net flow of water incident in the bow-to-stern direction, each limb having a forward edge and a rearward edge, the inner and outer surfaces extending between the forward and rearward edges, wherein each of the inner and outer surfaces is continuous over its entire length between the forward and rearward edges, and wherein at least one limb of the two limbs has a part having a leading edge which is locally swept relative to a central, longitudinal axis of the hull.

22. The vessel of claim 21, wherein longitudinal distance between the leading edge of the part and a rearmost part of the hull decreases with increasing distance from the hull.

23. A vessel for traveling on water, comprising:

a hull; and a keel comprising a member depending from the hull, the member comprising two limbs each depending from a respective lateral side of the hull, the two limbs defining at least in part an enclosed flow path extending in a bow-to-stern direction, the enclosed flow path being configured to allow water incident on the vessel to flow over inner and outer surfaces of the two limbs, wherein the two limbs each have a foil surface which is angled to generate in use a component of hydrodynamic force directed outwardly from the enclosed flow path when there is a net flow of water incident in the bow-to-stern direction, each limb having a forward edge and a rearward edge, the inner and outer surfaces extending between the forward and rearward edges, wherein each of the inner and outer surfaces is continuous over its entire length between the forward and rearward edges, and wherein each limb of the two limbs has a lower part which is longitudinally offset relative to an upper part thereof.

24. The vessel of claim 23, wherein the lower part of each limb of the two limbs is offset relative to the upper part towards a rear part of the hull.

* * * * *